US010058914B2

(12) United States Patent
Nooning

(10) Patent No.: US 10,058,914 B2
(45) Date of Patent: Aug. 28, 2018

(54) MULTIPLE PIECES CORE NOZZLE

(71) Applicant: NUCOR CORPORATION, Charlotte, NC (US)

(72) Inventor: Robert Nooning, Zionsville, IN (US)

(73) Assignee: Nucor Corporation, Charlotte, NC (US)

( * ) Notice: Subject to any disclaimer, the term of this patent is extended or adjusted under 35 U.S.C. 154(b) by 77 days.

(21) Appl. No.: 15/229,753

(22) Filed: Aug. 5, 2016

(65) Prior Publication Data

US 2017/0036266 A1 Feb. 9, 2017

Related U.S. Application Data

(60) Provisional application No. 62/201,802, filed on Aug. 6, 2015.

(51) Int. Cl.

| | |
|---|---|
| ***B22D 11/06*** | (2006.01) |
| ***B22D 11/10*** | (2006.01) |
| ***B22D 11/14*** | (2006.01) |
| ***B22D 41/50*** | (2006.01) |

(52) U.S. Cl.

CPC ..... *B22D 11/0622* (2013.01); *B22D 11/0642* (2013.01); *B22D 11/10* (2013.01); *B22D 11/142* (2013.01)

(58) Field of Classification Search

CPC . B22D 11/06; B22D 11/0622; B22D 11/0642; B22D 11/10; B22D 11/14; B22D 11/142; B22D 41/50

USPC ..... 164/154.5, 428, 437, 438, 480, 488; 222/594, 606, 607

See application file for complete search history.

(56) References Cited

U.S. PATENT DOCUMENTS

| | | | | |
|---|---|---|---|---|
| 5,857,514 | A | 1/1999 | Shook et al. | |
| 6,012,508 | A * | 1/2000 | Folder | B22D 11/0642 164/428 |
| 6,588,492 | B1 | 7/2003 | Fish et al. | |
| 7,757,747 | B2 | 7/2010 | McIntosh | |
| 8,047,264 | B2 | 11/2011 | Bowman et al. | |
| 8,141,618 | B2 | 3/2012 | Blejde et al. | |
| 8,225,845 | B2 | 7/2012 | Schlichting et al. | |
| 8,251,127 | B2 | 8/2012 | Ondrovic et al. | |
| 8,646,513 | B2 | 2/2014 | Schlichting et al. | |

(Continued)

OTHER PUBLICATIONS

PCT/US2016/045794 International Search Report and Written Opinion dated Oct. 26, 2016, 16 pages.

*Primary Examiner* — Kevin P Kerns

(74) *Attorney, Agent, or Firm* — Hahn Loeser & Parks LLP

(57) ABSTRACT

A metal delivery nozzle for a twin roll caster adapted to extend along and above a pair of casting rolls has a main portion with one or two refractory pieces with outlets adapted to deliver molten metal to a casting pool supported by the casting rolls during casting; refractory delivery end portions separately supported adapted to move relative to the main portion at each end portion of the metal delivery nozzle, each refractory delivery end portion having a reservoir portion with passages there through adapted to deliver molten metal to the casting pool adjacent the side dams and the end portions of the casting rolls; and a mechanism connected to each refractory delivery end portion adapted to move said refractory delivery end portion relative to the main portion as casting proceeds to maintain desired distance between the refractory delivery end portions and the side dams.

16 Claims, 8 Drawing Sheets

(56) References Cited

U.S. PATENT DOCUMENTS

| | | | | |
|---|---|---|---|---|
| 8,813,828 | B2 | 8/2014 | McQuillis et al. | |
| 8,978,738 | B2 | 3/2015 | McQuillis et al. | |
| 2009/0255644 | A1* | 10/2009 | Otsuka et al. ..... | B22D 11/0622 164/428 |
| 2010/0230070 | A1* | 9/2010 | Bowman et al. ..... | B22D 11/06 164/463 |
| 2011/0132568 | A1* | 6/2011 | Schlichting et al. ..... | B22D 11/0622 164/463 |
| 2013/0146245 | A1 | 6/2013 | McQuillis et al. | |

* cited by examiner

MULTIPLE PIECES CORE NOZZLE

This application claims priority to and the benefit of U.S. Provisional Application No. 62/201,802, filed on Aug. 6, 2015, which is incorporated by reference in its entirety.

BACKGROUND AND SUMMARY

This invention relates to making thin strip and, more particularly, casting of thin strip by a twin roll caster.

In a twin roll caster, molten metal is introduced between a pair of laterally positioned casting rolls that are counter-rotated and cooled so that metal shells solidify on the moving roll surfaces and are brought together at a nip between them to produce a solidified strip product (delivered downwardly from the nip between the casting rolls). The term "nip" is used herein to refer to the general region where the casting rolls are closest together. The molten metal is delivered from a ladle into a smaller vessel or vessels from which the molten metal flows through a metal delivery nozzle or delivery nozzles positioned side by side (also called the "core nozzles") and form a casting pool of molten metal supported on the casting surfaces of the casting rolls and extending the length of the nip. This casting pool is locally confined by side plates or dams held in sliding engagement adjacent end portions of the casting rolls to confine the casting pool against outflow.

More particularly, the metal delivery nozzles receive molten metal from a movable tundish and deliver the molten metal in the casting pool in a desired flow pattern. Various designs for delivery nozzles have been previously proposed involving a lower portion submerged in the casting pool during a casting campaign, and having side openings through which the molten metal is capable of flowing laterally outwardly into the casting pool toward the casting surfaces of the rolls. Examples of such metal delivery nozzles are disclosed in U.S. Pat. No. 6,012,508. In prior art metal delivery nozzles, there has been a tendency to produce thin cast strip with defects from uneven solidification of the molten metal.

To inhibit certain defects in the cast strip, the conditions of the molten metal in the casting pool, including temperature, composition and flow rate, have been controlled. Particularly, controlling the flow rate and molten metal temperature in the area near where the side dams, casting rolls and meniscus of the casting pool intersect (i.e. the "triple point" area or region) is important to improve thin strip quality.

The formation of solid pieces known as "skulls" occur in the casting pool in the vicinity of the confining side plates or dams. The rate of heat loss from the casting pool is higher near the side dams in the "triple point region" due to conductive heat transfer through the side dams to the casting rolls. This localized heat loss near the side dams has a tendency to form skulls of solid metal in that region, which can grow to a considerable size and fall between the casting rolls causing defects in the cast strip. An increased flow of molten metal to these triple point regions near the side dams have been provided. See, U.S. Pat. No. 4,694,887 and U.S. Pat. No. 5,221,511. Increased heat input to these triple point regions has reduced formation of skulls.

To control flow in the triple point region, the distance between the side dams and the ends of the delivery nozzles near the side dams should be controlled and maintained during casting. This distance has been found so sensitive that even compensation for wear of the side dams needs to addressed. The approach in the past has been to provide a common support for each side dam and adjacent end portion of the delivery nozzle. In the past, coupling of the positioning and support for the delivery nozzles and side dams enabled control of the distance between the side dams and end portions of a delivery nozzle to improve the strip quality.

Such apparatus and methods for controlling the distance between the outer end portions of the delivery nozzles and the side dams during a campaign are disclosed in U.S. Pat. Nos. 6,910,523, 6,588,492, and 7,147,035. The apparatus and method disclosed have a carriage assembly to commonly supporting the side dams and end portions of the delivery nozzles and maintain distance between the side dams and end portions of the delivery nozzles with wear of the side dams. This common support maintains the distance between the side dam and end of the delivery nozzle. The delivery nozzles could be moved relative to the side dams by the carriage assembly during casting; however, the movement also involved simultaneously moving of both delivery nozzle and the adjacent side dam. This movement affects the side dam force and, thus, side dam wear. Moreover, the movement of the side dam by the support to compensate for wear of the side dam required repositioning of the delivery nozzle to maintain the distance between the side dam and the end portion of the near delivery nozzle.

Additionally, repositioning side by side delivery nozzles during the casting campaign as the side dam wears involves providing in a large gap between the refractory pieces of the main portion of the delivery nozzle in the center of the casting pool at the start of the casting campaign and a small gap between these refractory pieces of the main portion of the delivery nozzle at the end of the casting campaign. That in turn caused a ridge in the thickness at the center of the cast strip at the beginning of the cast and a dip in the thickness at the center of the cast strip toward the end of the cast, respectively.

We have found that quality of thin strip casting, particularly with control of skulls in the triple point region can be improved by entirely different approach with a delivery nozzle in which the refractory delivery end portions are separated from the main portion during the casting campaign. Having refractory delivery end portions and main portion separately supported during the casting campaign allows for control and maintenance of a set distance between the refractory delivery end portions of the delivery nozzle and the side dams throughout a casting campaign, while also controlling and maintaining a set end to end distance between the refractory pieces of the main portion at the center of the delivery nozzle.

Presently disclosed is a method for casting metal strip comprising:

(a) assembling a pair of casting rolls laterally disposed to form a nip between them, and adapted to support a casting pool of molten metal, with side dams positioned adjacent end portions of the casting rolls to confine the casting pool laterally;

(b) assembling an elongated metal delivery nozzle extending along and above the nip between the casting rolls, with a main portion comprising one or two refractory pieces with outlets adapted to deliver molten metal to the casting pool supported by the casting rolls, and refractory delivery end portions separately supported during casting adapted to move relative to the main portion at each end portion of the metal delivery nozzle, each refractory delivery end portion having a reservoir portion with passages there through adapted to deliver molten metal to the casting pool adjacent the side dams and the end portions of the casting rolls;

(c) providing a mechanism connected to each refractory delivery end portion adapted to move each refractory delivery end portion relative to the main portion as casting proceeds to maintain desired distance between the refractory delivery end portions and the side dams;

(d) delivering molten metal through the elongated metal delivery nozzle adapted to communicate through the outlets of the main portion with the casting pool of molten metal supported by the casting rolls, such that molten metal is caused to flow from the main portion through said outlets and through the reservoir portion passages of the refractory delivery end portions into the casting pool; and (e) counter rotating the casting rolls to deliver cast strip downwardly from the nip as casting proceeds.

The method of casting metal strip may further comprise:

(f) connecting the refractory delivery end portions to the main portion during preheating; and (g) separating the refractory delivery end portions from the main portion for casting.

In an embodiment, the method for casting metal strip may comprise a delivery nozzle with a main portion comprising two refractory pieces. The two refractory pieces may be positioned end-to-end. Each refractory piece of the main portion may have outlets adapted to deliver molten metal there through to the casting pool supported by the casting rolls. A mechanism is connected to each refractory piece that may be adapted to move each refractory piece relative to the other refractory piece. The refractory pieces may be positioned at a distance between 0.5 to 60 mm from each other. The distance between the refractory pieces may be adjusted during casting.

In another embodiment, the method for casting metal strip may comprise a metal delivery nozzle with a main portion comprising one refractory piece. The refractory delivery end portions may be positioned at each end of the main portion, but separately supported from the main portion during a casting campaign. Each refractory delivery end portion may be adapted to move relative to the main portion at each end portion of the metal delivery nozzle during casting. A mechanism is connected to each refractory delivery end portion that may be adapted to move said refractory delivery end portion relative to the main portion as casting proceeds to maintain desired distance between the respective refractory delivery end portions and the side dams.

The method for casting metal strip may further comprise positioning sensors to sense the positions of the refractory delivery end portions of the delivery nozzle and the side dams, and produce electrical signals indicative of said positions of the refractory delivery end portions of the delivery nozzle and the side dams positions. Additionally, the method for casting metal strip may further comprise controlling the positions of the refractory delivery end portions of the delivery nozzle and of the side dams responsive to said electrical signals produced by sensors so as to adjust the positions of the refractory delivery end portions of the delivery nozzle and of the side dams responsive to wear of said side dams.

The method for casting metal strip may further comprise positioning sensors to sense the positions of the refractory pieces of the main portion and of the refractory delivery end portions of the delivery nozzle, and produce electrical signals indicative of said positions. Additionally, the method for casting metal strip may further comprise controlling the positions of refractory piece or pieces of the main portion and of the refractory delivery end portions of the delivery nozzle responsive to said electrical signals produced by the sensors so as to adjust the positions of refractory pieces of the main portion and of the refractory delivery end portions relative to each other during casting.

Alternatively or in addition, the method for casting metal strip may further comprise positioning sensors to sense the positions of the refractory piece or pieces of the main portion, of the refractory delivery end portions of the delivery nozzle and of the side dams, and produce electrical signals indicative of said positions. Additionally, the method for casting metal strip may further comprise controlling the positions of the refractory piece or pieces of the main portion, of the refractory delivery end portions of the delivery nozzle and of the side dams responsive to said electrical signals produced by sensors so as to adjust the positions of the refractory delivery end portions of the delivery nozzle and of the side dams responsive to wear of said side dams.

Also disclosed is a metal delivery nozzle for a twin roll caster adapted to extend along and above a pair of casting rolls comprising:

a main portion comprising one or two refractory pieces with outlets adapted to deliver molten metal to a casting pool supported by the casting rolls during casting;

refractory delivery end portions separately supported adapted to move relative to the main portion at each end portion of the metal delivery nozzle, each refractory delivery end portion having a reservoir portion with passages there through adapted to deliver molten metal to the casting pool adjacent the side dams and the end portions of the casting rolls; and a mechanism connected to each refractory delivery end portion adapted to move said refractory delivery end portion relative to the main portion as casting proceeds to maintain desired distance between the refractory delivery end portions and the side dams.

In an embodiment, the main portion may comprise two refractory pieces positioned end-to-end. Each refractory piece has outlets and may be adapted to deliver molten metal through said outlets to the casting pool supported by the casting rolls. A mechanism connected to each refractory piece may be provided to move each refractory piece relative to the other refractory piece. The refractory pieces of the main portion may be positioned at a distance between 0.5 to 60 mm from each other. The distance between the refractory pieces may vary during casting.

In another embodiment, the metal delivery nozzle has a main portion comprised of one refractory piece with outlets adapted to deliver molten metal to the casting pool supported by the casting rolls. A refractory delivery end portion may be located at each end of the main portion. Each refractory delivery end portion may be adapted to move relative to the main portion at each end portion of the metal delivery nozzle. Additionally, each delivery end portion may be connected to the main portion during preheating and separated from the main portion during casting.

The metal delivery nozzle for a twin roll caster adapted to extend along and above a pair of casting rolls may further comprise sensors to sense the positions of the refractory delivery end portions of the delivery nozzle and the side dams, and produce electrical signals indicative of said positions between the refractory delivery end portions of the delivery nozzle and the side dams. Additionally, the metal delivery nozzle for a twin roll caster adapted to extend along and above a pair of casting rolls may further comprise a control system adapted to control the positions of the refractory delivery end portions of the delivery nozzle and of the side dams responsive to said electrical signals produced by sensors so as to adjust the positions of the refractory delivery end portions of the delivery nozzle and of the side dams responsive to wear of the side dams.

Alternatively or in addition, the metal delivery nozzle for a twin roll caster adapted to extend along and above a pair of casting rolls may comprise sensors to sense the positions of the refractory piece or pieces of the main portion and of the refractory delivery end portions of the delivery nozzle, and produce electrical signals indicative of said positions. Additionally, the metal delivery nozzle for a twin roll caster adapted to extend along and above a pair of casting rolls may further comprise a control system adapted to control the positions of refractory piece or pieces of the main portion, of the refractory delivery end portions of the delivery nozzle and of the side dams responsive to said electrical signals produced by the sensors so as to adjust the positions of refractory piece or pieces of the main portion and of the refractory delivery end portions relative to each other.

In either embodiment, a mechanism may be connected to each refractory delivery end portion adapted to move said refractory delivery end portion relative to the main portion as casting proceeds to maintain a desired distance between the refractory delivery end portions and the side dams, the mechanism may be selected from the group consisting of servo-mechanisms, hydraulic mechanisms, pneumatic mechanisms, gear mechanisms, cog actuators, drive chain mechanisms, pulley and cable mechanisms, drive screw mechanisms, jack actuators, rack and pinion mechanisms, electro-mechanical actuators, electric motors, linear actuators, and rotating actuators.

Various aspects of this invention will become apparent from the following detailed description and accompanying drawings.

DETAILED DESCRIPTION OF THE DRAWINGS

Figure 1:
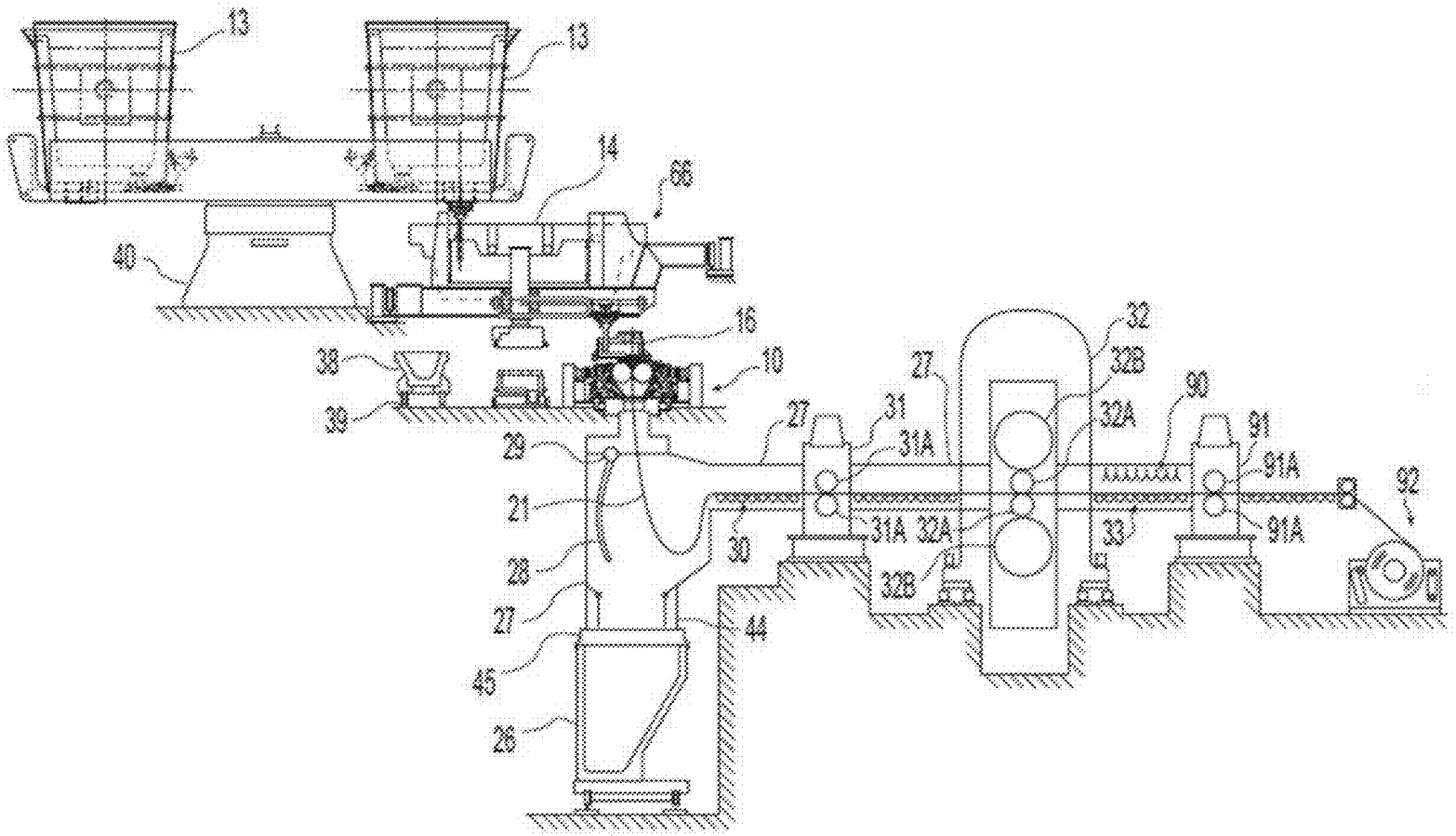
FIG. 1 is an illustrative side view of a portion of a twin roll caster of the present disclosure.
Figure 2:
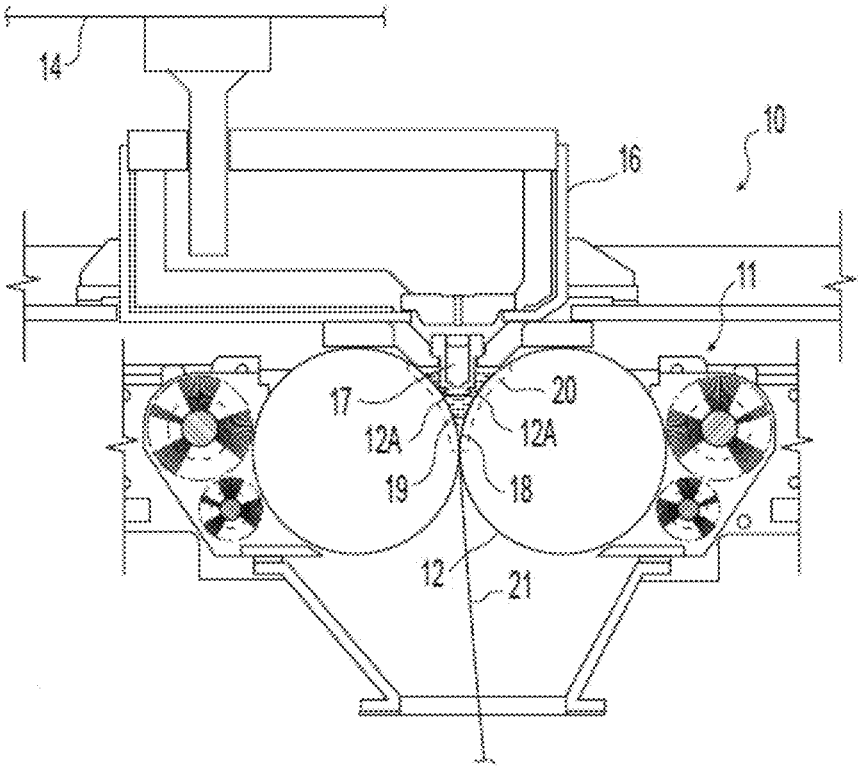
FIG. 2 is a partial sectional view through the casting rolls mounted in a roll cassette in the casting position of the caster of FIG. 1.

Referring now to the drawings, there is illustrated in FIGS. 1 and 2 a portion of a twin roll caster for continuously casting thin steel strip that comprises a main machine frame 10 that that stands up from the factory floor and supports a roll cassette module 11 including a pair of counter-rotatable casting rolls 12 mounted therein. The casting rolls 12 having casting surfaces 12A laterally positioned to form a nip 18 there between. The casting rolls 12 are mounted in the roll cassette 11 for ease of operation and movement. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls for casting.

Molten metal is supplied from a ladle 13 through a metal delivery system including a movable tundish 14 and a transition piece or distributor 16, and the molten metal flows to at least one metal delivery nozzle 17, or core nozzle, positioned between the casting rolls 12 above the nip 18. Molten metal discharged from the delivery nozzle 17 forms a casting pool 19 of molten metal above the nip 18 supported on the casting surfaces 12A of the casting rolls 12. This casting pool 19 is laterally confined in the casting area at the ends of the casting rolls 12 by a pair of side closures or plate side dams 20 (shown in dotted line in FIG. 2). The upper surface of the casting pool 19 (generally referred to as the "meniscus" level) typically is above the bottom portion of the delivery nozzle 17 during casting with the lower part of the delivery nozzle 17 immersed in the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to deliver molten metal to the tundish. The movable tundish 14 may be positioned on a tundish car 66 capable of transferring the tundish from a heating station (not shown), where the tundish is preheated to near casting temperature, to the casting position. A tundish guide, such as rails, may be positioned beneath the tundish car 66 to enable moving the movable tundish 14 from the preheating station to the casting position.

The movable tundish 14 may be fitted with a slide gate (not shown), actuable by a servo mechanism, to allow molten metal to flow from the tundish 14 through the slide gate, and then through a refractory outlet shroud (not shown) to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting rolls move into and through the casting pool 19 with each revolution of the casting rolls 12. The shells are brought together at the nip 18 between the casting rolls 12 to produce solidified thin cast strip product 21 delivered downwardly from the nip 18. The gap between the casting rolls is such as to maintain separation between the solidified shells at the nip and form a semi-solid metal in the space between the shells through the nip, and is, at least in part, subsequently solidified between the solidified shells within the cast strip below the nip.

FIG. 1 shows the twin roll caster producing the thin cast strip 21, which passes across guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces corresponding to the desired strip profile across the work rolls. The hot rolled cast strip then passes onto a run-out table 33, where the strip is cooled by contact with a coolant, such as water, supplied via water jets 90 or other suitable means, and by convection and radiation. In any event, the hot rolled cast strip then passes through a second pinch roll stand 91 having rollers 91A to provide tension of the cast strip, and then to a coiler 92. The cast strip typically is between about 0.3 and 2.0 millimeters in thickness before hot rolling by hot rolling mill 32.

At the start of the casting operation, a short length of imperfect strip is typically produced as casting conditions stabilize. After continuous casting is established, the casting rolls are moved apart slightly and then brought together again to cause the leading end of the cast strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At then, a water-cooled apron 28 that normally hangs downwardly from a pivot 29 to one side in the enclosure 27 is swung into position to guide the clean end of the cast strip 21 onto the guide table 30 that feeds the strip to the pinch roll stand 31. The apron 28 is then retracted back to its hanging position to allow the cast strip 21 to hang in a loop beneath the casting rolls in enclosure 27 before the strip passes onto the guide table 30 and engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

Sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. Sealed, the enclosure 27 and scrap receptacle 26 are filled with a desired gas, such as nitrogen, to reduce the amount of oxygen in the enclosure and provide a protective atmosphere for the cast strip.

Referring to FIGS. 3 to 8, there is illustrated a delivery nozzle for a twin roll caster adapted to extend along and above a pair of casting rolls comprising a main portion with one or two refractory pieces with outlets adapted to deliver molten metal to a casting pool supported by the casting rolls during casting, and refractory delivery end portions separately supported adapted to move relative to the main portion at each end portion of the metal delivery nozzle. Each refractory delivery end portion has a reservoir portion with passages there through adapted to deliver molten metal to the casting pool adjacent the side dams and the end portions of the casting rolls.

Figure 3:
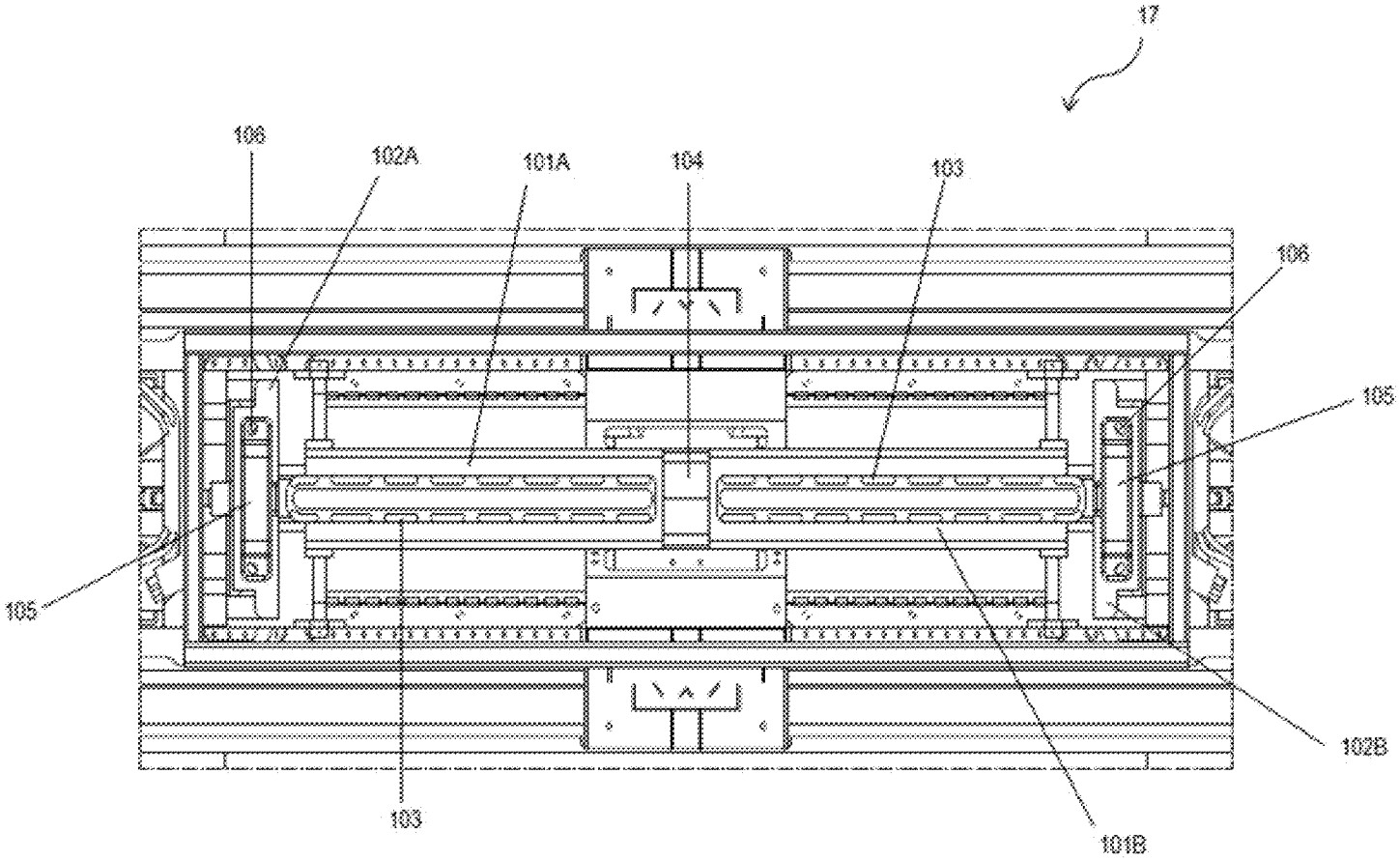
FIG. 3 is a top view of a metal delivery nozzle for use in the twin roll caster shown in FIG. 1.
Figure 4:
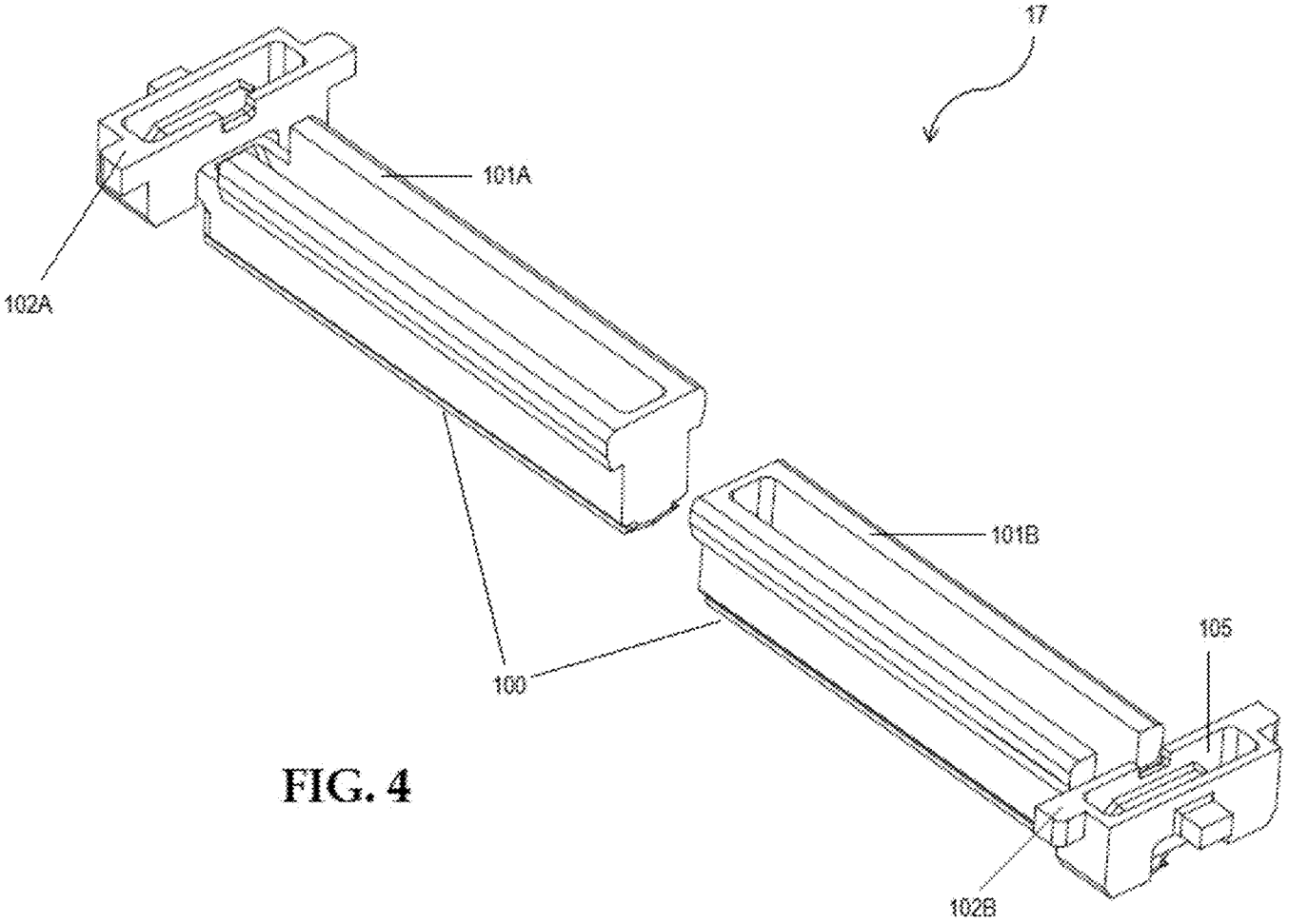
FIG. 4 is a plan view of a metal delivery nozzle comprising a main portion with two refractory pieces and refractory delivery end portions.

There is shown in FIGS. 3 and 4 delivery nozzle 17 having a main portion 100 comprised of two refractory pieces 101A and 101B and refractory delivery end portions 102A and 102B. Refractory pieces 101A and 101B have outlets 103 and are adapted to deliver molten metal to the casting pool supported by the casting rolls. The refractory pieces 101A and 101B may be made of refractory material such as zirconia graphite, alumina graphite or any other suitable material.

Each refractory piece 101A and 101B may be capable of moving independently of the other. As shown in FIGS. 3 and 4, the refractory pieces are positioned end-to-end with a gap 104 there between, so that each refractory piece can be moved inwardly toward each other during a casting campaign. The refractory pieces may be positioned at a distance between 0.5 to 60 mm from each other, said distance varied during casting.

A sensor (not shown) may be included to sense the positions of each refractory piece with respect of each other. The sensor may produce electrical signals indicative of the positions of the refractory piece or pieces of the main portion, of the refractory delivery end portions and of the side dams.

As shown in FIGS. 3 and 4, refractory delivery end portions 102A and 102B are separately supported. The refractory delivery end portions may be made of refractory material such as zirconia graphite, alumina graphite or any other suitable material. Each refractory delivery end portion has a reservoir portion 105 with passages 106 there through adapted to deliver molten metal from the delivery nozzle to the casting pool adjacent the side dams and the end portions of the casting rolls. Each refractory delivery end portion is adapted to move relative to the main portion at each end of the metal delivery nozzle. A mechanism (not shown) is provided connected to each refractory delivery end portion adapted to move said refractory delivery end portion relative to the main portion as casting proceeds to maintain a desired distance between the refractory delivery end portions and the side dams.

A sensor (not shown) may be included to sense the positions of the main portion, of the refractory delivery end portions of the delivery nozzle and of the side dams, and produce electrical signals indicative of said positions of the main portion, of the refractory delivery end portions of the delivery nozzle and of the side dams positions. The sensors may be suitable to indicate parameter representative of the position of the main portion, of the refractory delivery end portions of the delivery nozzle and of the side dams. For example, a suitable sensor may be a linear variable displacement transformer to respond to the extension of the mechanism adjacent each refractory delivery end portion to provide signals indicative of movement of the refractory delivery end portion relative to the main portion as casting proceeds in order to maintain desired distance between the refractory delivery end portions and the side dams. Alternatively, the sensor may be an optical imaging device for tracking the position of the refractory delivery end portions with respect to the main portion.

A control system (not shown) may also be included. The control system may be adapted to control the positions of the main portion, of the refractory delivery end portions of the delivery nozzle and of the side dams responsive to said electrical signals produced by the sensors so as to adjust the positions of the main portion, of the refractory delivery end portions of the delivery nozzle and of the side dams responsive to wear of said side dams.

Figure 5:
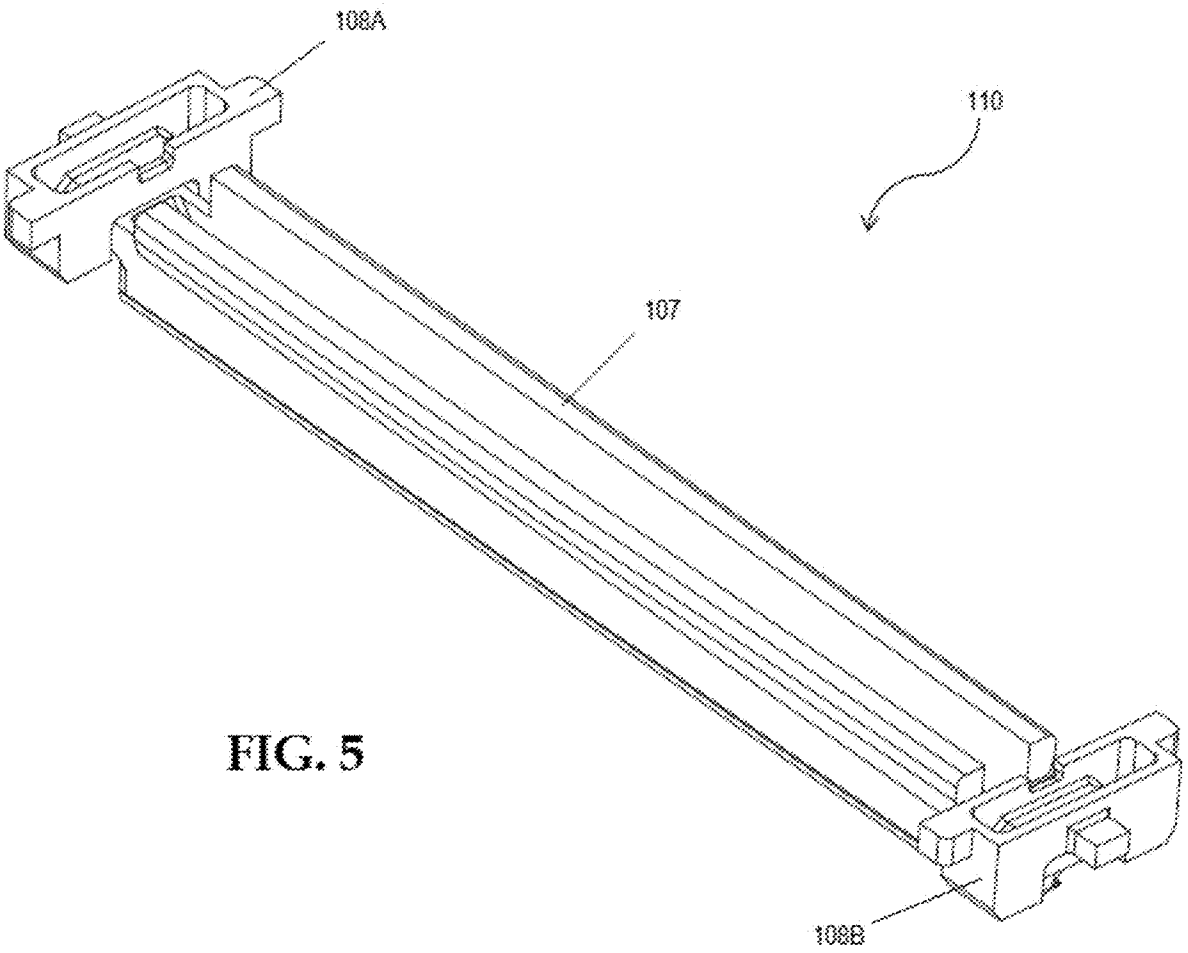
FIG. 5 is a plan view of a metal delivery nozzle comprising a main portion with one refractory piece and refractory delivery end portions.

As shown in FIG. 5, a delivery nozzle 110 may comprise a main portion 107 with one refractory piece having outlets adapted to deliver molten metal to the casting pool supported by the casting rolls. Refractory delivery end portions 108A and 108B may be located at each end of the delivery nozzle. Each refractory delivery end portion may be adapted to move relative to the main portion at each end portion of the metal delivery nozzle.

Figure 6:
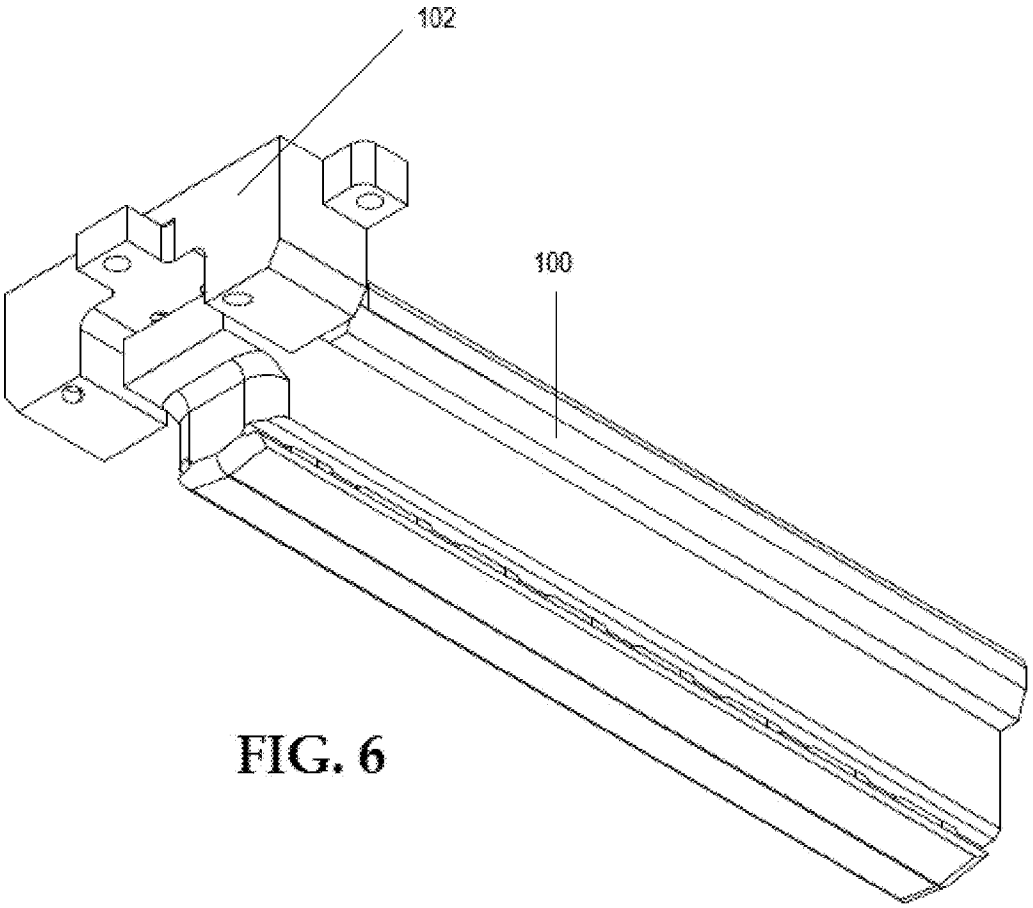
FIG. 6 is a bottom view of a metal delivery nozzle.
Figure 7:
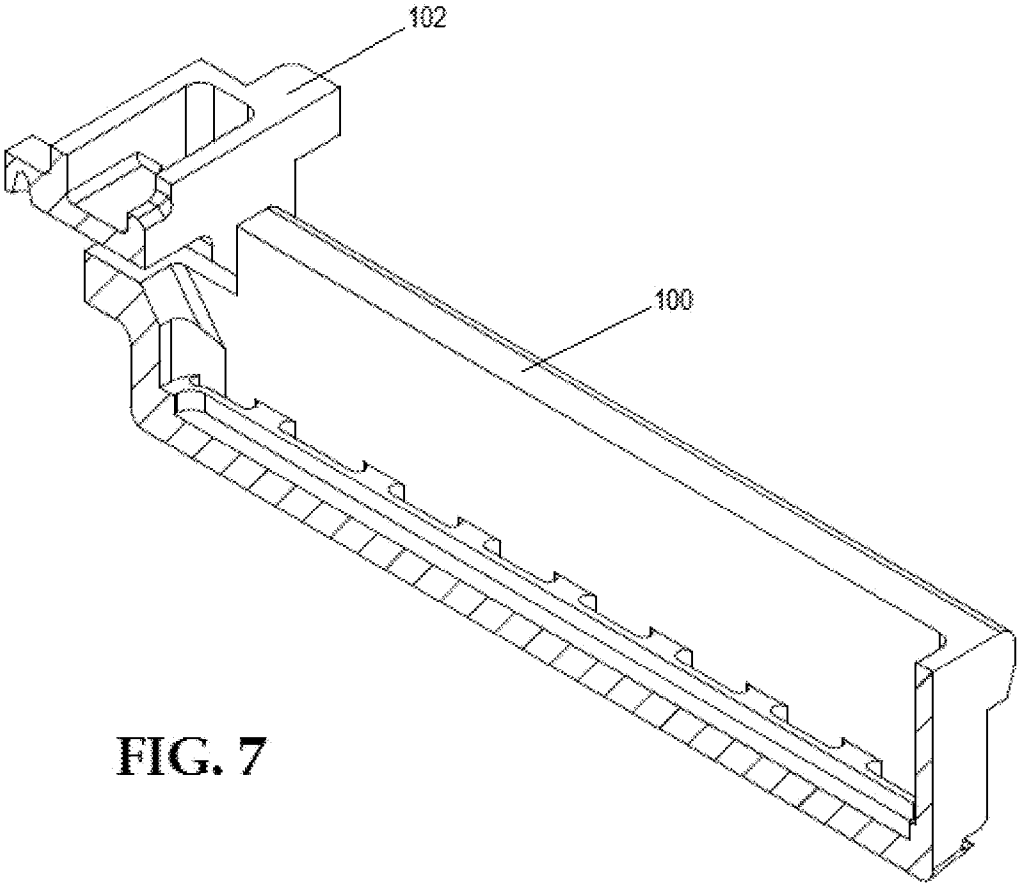
FIG. 7 is a cross-sectional view of a metal delivery nozzle.
Figure 8:
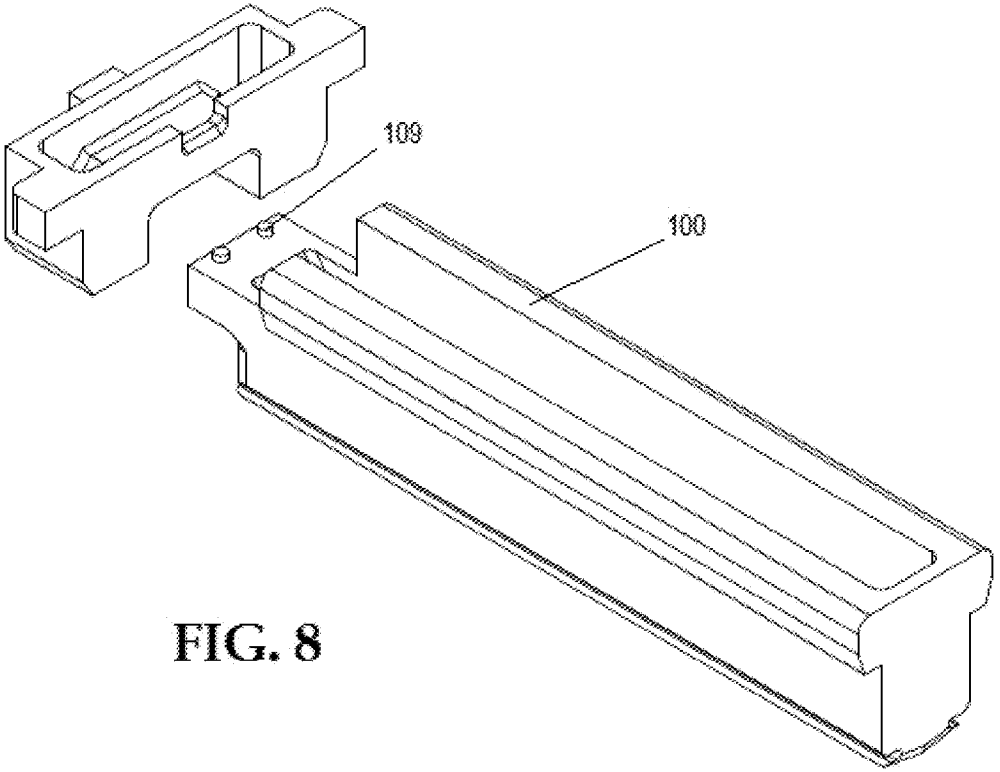
FIG. 8 is a plan view of a metal delivery nozzle with separated main portion and refractory delivery end portions.

As shown in FIGS. 6-8, each delivery end portion may be connected for example by pins to the main portion during preheating and separated from the main portion during casting. During preheating, each refractory delivery end portion 102 may be connected to main portion 100 using refractory pins 109. During the casting campaign, each refractory delivery end portion 102 is separated from the main portion 100. A mechanism (not shown) may be connected to each refractory delivery end portion to move the refractory delivery end portions relative to the main portion as casting proceeds and maintain a desired distance between the refractory delivery end portions and the side dams.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. A method of casting metal strip comprising:

(a) assembling a pair of casting rolls laterally disposed to form a nip between them, and adapted to support a casting pool of molten metal to be cast, with side dams positioned adjacent end portions of the casting rolls to confine the casting pool laterally;

(b) assembling an elongated metal delivery nozzle extending along and above the nip between the casting rolls, with a main portion comprising one or two refractory pieces with outlets adapted to deliver molten metal to the casting pool supported by the casting rolls, and refractory delivery end portions separately supported and adapted to move relative to the main portion at each end portion of the metal delivery nozzle, each delivery end portion having a reservoir portion with passages there through and adapted to deliver molten metal to the casting pool adjacent the side dams and the end portions of the casting rolls;

(c) providing a mechanism adjacent each refractory delivery end portion where the mechanism is adapted to move each refractory delivery end portion relative to the main portion as casting proceeds to maintain a desired distance between the refractory delivery end portions and the side dams;

(d) delivering molten metal through the elongated metal delivery nozzle adapted to communicate through the outlets of the main portion with the casting pool of molten metal supported by the casting rolls, such that molten metal is caused to flow from the main portion through said outlets and through the reservoir portion passages of the refractory delivery end portions into the casting pool; and (e) counter rotating the casting rolls to deliver cast strip downwardly from the nip as casting proceeds.

2. The method of casting metal strip as claimed in claim 1 further comprising:

(f) pinning the refractory delivery end portions to the main portion during preheating; and (g) separating the refractory delivery end portions from the main portion during casting.

3. The method of casting metal strip as claimed in claim 1 where the main portion comprises two refractory pieces positioned end-to-end, each refractory piece adapted to deliver molten metal through the outlets to the casting pool supported by the casting rolls, and each refractory delivery end portion is adapted to move during casting relative to the main portion at each end portion of the metal delivery nozzle.

4. The method of casting metal strip as claimed in claim 3 where the refractory pieces are positioned a distance between 0.5 to 60 mm from each other.

5. The method of casting metal strip as claimed in claim 3 further comprising providing a mechanism adjacent each refractory piece where the mechanism is adapted to move each refractory piece a distance relative to the other refractory piece.

6. The method of casting metal strip as claimed in claim 5 where the distance between the refractory pieces varies during casting.

7. The method of casting metal strip as claimed in claim 1 where the main portion is in one refractory piece adapted to deliver molten metal to the casting pool supported by the casting rolls, and each refractory delivery end portion is adapted to move relative to the main portion at each end portion of the metal delivery nozzle.

8. The method of casting metal strip as claimed in claim 1 where the mechanisms adapted to move the refractory delivery end portions relative to the main portion are synchronized to move together.

9. The method of casting metal strip as claimed in claim 1 where refractory delivery end portions deliver molten metal within 50 millimeters of the side dams adjacent each end of the delivery nozzle.

10. A metal delivery nozzle adapted to extend along and above a pair of casting rolls' the metal delivery nozzle comprising:

a main portion comprising one or two refractory pieces with outlets adapted to deliver molten metal to a casting pool supported by the casting rolls during casting;

refractory delivery end portions separately supported and adapted to move relative to the main portion at each end portion of the metal delivery nozzle, each refractory delivery end portion having a reservoir portion with passages there through and adapted to deliver molten metal to the casting pool adjacent a side dam and the end portions of the casting rolls; and a mechanism adjacent each refractory delivery end portion where the mechanism is adapted to move said refractory delivery end portion relative to the main portion as casting proceeds to maintain a desired distance between the refractory delivery end portion and the side dam.

11. The metal delivery nozzle as claimed in claim 10 where the main portion comprises two refractory pieces positioned end-to-end, each refractory piece with outlets adapted to deliver molten metal to the casting pool supported by the casting rolls, and each delivery end portion adapted to move relative to the main portion at each end portion of the metal delivery nozzle.

12. The metal delivery nozzle as claimed in claim 11 where the refractory pieces are positioned a distance between 0.5 to 60 mm from each other.

13. The metal delivery nozzle as claimed in claim 11 further comprising providing a mechanism adjacent each refractory piece where the mechanism is adapted to move each refractory piece a distance relative to the other refractory piece.

14. The metal delivery nozzle as claimed in claim 13 where the distance between the refractory pieces varies during casting.

15. The metal delivery nozzle as claimed in claim 10 where the main portion comprises one refractory piece with outlets adapted to deliver molten metal to the casting pool supported by the casting rolls, and each delivery end portion is adapted to move relative to a main portion at each end portion of the metal delivery nozzle.

16. The metal delivery nozzle as claimed in claim 10 where the main portion comprises one refractory piece with outlets adapted to deliver molten metal to the casting pool supported by the casting rolls, and each delivery end portion is pinned to the main portion during preheating and separated from the main portion during casting.

* * * * *